US008591802B2

(12) United States Patent
Koffron et al.

(10) Patent No.: US 8,591,802 B2
(45) Date of Patent: Nov. 26, 2013

(54) VORTEX INHIBITOR

(75) Inventors: Robert J. Koffron, Farmington Hills, MI (US); Ross A. Jacobs, Snowmass, CO (US); John W. Dresh, Bridgman, MI (US)

(73) Assignee: Tetron, Inc., Farmington Hills, MI (US)

( * ) Notice: Subject to any disclaimer, the term of this patent is extended or adjusted under 35 U.S.C. 154(b) by 25 days.

(21) Appl. No.: 12/747,333

(22) PCT Filed: Dec. 11, 2008

(86) PCT No.: PCT/US2008/086466

§ 371 (c)(1), (2), (4) Date: Sep. 3, 2010

(87) PCT Pub. No.: WO2009/076546

PCT Pub. Date: Jun. 18, 2009

(65) Prior Publication Data

US 2011/0186602 A1 Aug. 4, 2011

Related U.S. Application Data

(60) Provisional application No. 60/007,459, filed on Dec. 11, 2007.

(51) Int. Cl.
*B22D 41/50* (2006.01)

(52) U.S. Cl.
USPC ..... 266/227; 266/45; 222/594

(58) Field of Classification Search
USPC ..... 266/45, 227, 236; 222/594, 597
See application file for complete search history.

(56) References Cited

U.S. PATENT DOCUMENTS

| | | | | |
|---|---|---|---|---|
| 4,799,650 | A * | 1/1989 | Labate | 266/227 |
| 5,044,610 | A * | 9/1991 | Koffron | 266/45 |
| 2004/0164466 | A1 * | 8/2004 | Koffron et al. | 266/236 |
| 2007/0054020 | A1 * | 3/2007 | Kumagai | 426/524 |

* cited by examiner

*Primary Examiner* — Scott Kastler
(74) *Attorney, Agent, or Firm* — Shook Hardy & Bacon LLP

(57) ABSTRACT

An improved vortex inhibitor 20 for separating slag from molten metal during the discharge of molten metal through a nozzle 14 includes a generally uniform castable refractory body 22 having a generally hemispherical or hemi-ellipsoid shape having a plurality of generally triangular shaped projection elements 30, 32, 34, 36, 38 and 40) defining a plurality of generally constant dimension grooves 42, 44, 46, 48, 50 and 52 extending downward from the top side 26 toward an apex 41 of the vortex inhibitor 20.

7 Claims, 3 Drawing Sheets

VORTEX INHIBITOR

CROSS-REFERENCE TO RELATED PATENT APPLICATIONS

This application claims the benefit of and priority to U.S. Provisional Patent Application No. 60/007,459, filed Dec. 11, 2007, titled: VORTEX INHIBITOR FOR MOLTEN METAL DISCHARGE HAVING CONSTANT DIMENSION GROOVES, in the name of Koffron et al., which is incorporated by reference herein.

BACKGROUND

The present invention relates generally to metal making apparatus and more particularly to apparatus for separating slag from molten metal as the molten metal is transferred from a receptacle. This article has a hemispherical shape and has a plurality of constant dimension grooves extending downward from its top.

In the metal making processes, the flow of molten metal through the discharge nozzle of a receptacle such as a furnace, tundish or ladle induces a swirl to the molten metal above the discharge nozzle. At a certain level, the energy of the swirl creates a vortex, whereby the slag layer lying on top of the molten metal is sucked into the nozzle and mixes with the molten metal being poured through the nozzle. Several devices are known to inhibit introduction of the slag to the discharge nozzle in order to avoid the contamination of the poured metal. Before such devices were introduced, it was necessary to terminate pouring by closing the nozzle while the molten metal was at a level above the point at which suction action of the vortex draws slag downwardly into the discharge nozzle. Such a procedure traps a large amount of molten metal in the receptacle and reduces effective yield of the melt.

U.S. Pat. No. 4,494,734 LaBate, et al., discloses a dart incorporating a depending guide member engageable in the tap hole to direct accurate placement of the stopper body toward the tap hole. This patent discloses alternate configurations of the stopper body that are taught to cause swirling of the metal. This patent teaches that visual observation of the swirling metal and slag indicates when tapping of the furnace is to be terminated.

Many of the previously known devices for restricting slag from flowing through the discharge nozzle are in the form of plugs which lodge in the discharge nozzle to prevent further pouring through the nozzle. For example, U.S. Pat. No. 2,810,169 to Hofer discloses the use of a slag dam as well as a plug which is mechanically controlled for placement during the pouring operation. However, such units are large and expensive to build, and numerous parts are subjected to the harsh environmental conditions of molten metal. Consequently, the cost of repairing or replacing the parts substantially increases the costs of metal making.

Other known devices for separation of slag and molten metal during discharge comprise bodies which are self-supporting in the molten metal layer. This is accomplished by constructing the body with a specific gravity between the specific gravity of the molten metal and the specific gravity of the slag layer. One such device with such controlled density is a spherical body which is drawn by the vortex into the nozzle and lodges in the nozzle to obstruct further flow. However, such a device is difficult if not impossible to remove, and frequently requires replacement of the nozzle sleeve.

U.S. Pat. No. 4,526,349 to Schwer discloses an annular disc having a specific gravity that permits it to separate slag at the interface between the slag and steel. However, this patent also contemplates that a spherical body is drawn by the suction of the vortex into the discharge nozzle opening to cut off fluid flow. The patent discloses that two discrete articles are necessary. While the ring is taught to counter the effect of the vortex formed over the discharge nozzle, the sphere merely closes off pouring when slag is about to be introduced to the discharge nozzle. Consequently, the problems previously discussed are encountered.

A self-supporting device particularly developed to inhibit the vortex formation was disclosed in the present applicant's previous U.S. Pat. No. 4,601,415. That patent defines a tapered, polygonal body designed to generally conform to the shape of the vortex along its length so as to extract energy from swirling movement of the molten metal. Unlike previously known plug bodies, the patented vortex inhibitor is self-orienting by its vortex conforming shape. However, to assure that the apex is downwardly positioned, the patent also discloses a weighting means embedded in the refractory body. Moreover, while the patent teaches that the shape of a polygonal cross-section may be changed to adjust the degree of plugging or the throttling effect as the body enters the discharge nozzle, it was found that changing the shape of the vortex inhibitor from the tetrahedral shape of the preferred embodiment could affect the orientation stability of the body. In particular, as the body is subjected to outside influences during placement in the molten metal bath or during movement of the receptacle from which the molten metal is being discharged, the geometrical proportion can disrupt the desired apex downward orientation. Moreover, the use of a separate weighting means, such as a core, substantially increases the complexity of producing the vortex inhibitor and has been disfavored.

Accordingly, as with most technologies, there is room for improvement in the art of vortex inhibiting articles.

SUMMARY

The present disclosure overcomes the above-mentioned disadvantages by providing a vortex inhibitor made from a uniform castable refractory body having a hemispherical shape. The body includes a plurality of constant dimension grooves which extend downward from its top. The body is tapered from the top toward its apex. Thus proportioned the center of gravity is below the center of buoyancy and closer to the apex. As a result, the body orients itself apex downwardly in the molten metal without the time consuming and laborious efforts required to embed a weighting core within the refractory body.

In general, the vortex inhibitor of the present disclosure comprises a body made of uniform castable refractory material. It is to be understood that the term uniform does not require complete homogeneity of material and includes the intermixture of shot, steel fiber or other materials that may be consistently mixed with a castable refractory material to adjust the specific gravity of the body. In any event, the specific gravity of the uniform mixture is selected so that it is buoyantly supported at the interface of the slag layer and the molten metal layer.

The body has a substantially hemispherical shape and has a plurality of constant dimension grooves which extend from its top side toward its apex. This arrangement allows a constant draining capability whereby the bypass value of the liquid flow will be constant as the tap hole wears out. According to the provided constant draining capability, even though the tap hole is provided as the center of the device and, overall, the article provides a fairly constant plugging effect. This results in about the same throughput as if the normal practice were adopted of allowing the tap hole to wear out at a rate that the final tapping is approximately one half of the initial tapping time. Then, the draining of the vessel, which is usually inverse of that function, becomes a constant output at the termination of the tap. Accordingly, the article of the present disclosure actually functions as a disc with slotted relief openings.

The configuration of the article of the present disclosure allows the manufacturer to use less material in the production of the piece. Therefore, it is less costly to make.

The general shape of the article would allow a bore through the center of the piece, thus making it a very good candidate for a dart application as used in relation to a sacrificial rod, set forth in U.S. Pat. No. 6,723,275, for "Vortex Inhibitor With Sacrificial Rod," incorporated herein by reference.

Thus the present disclosure provides a body that is simple to make since it is easily formed by pouring a single mixture into a mold. Nevertheless, the body is automatically self-orienting so that its apex extends downwardly toward the discharge nozzle of a molten metal receptacle. As a result, the vortex inhibitor is self-aligning within the vortex swirl caused by the discharge of molten metal. In addition, a vortex inhibitor body constructed in accordance with the present disclosure maintains the separation of the center of gravity and the center of buoyancy relationship regardless of the number of sides, projections, recesses or other configurations used to deenergize the vortex-inducing swirl. As a result, the vortex inhibiting body can be constructed regardless of the throttling ratio necessary to interrupt discharge of the molten metal through the nozzle while maintaining separation between the slag layer and molten metal in the receptacle during a pouring operation.

BRIEF DESCRIPTION OF THE DRAWINGS

The present disclosure will be more clearly understood by reference to the following detailed description of a preferred embodiment when read in conjunction with the accompanying drawing in which like reference characters refer to like parts throughout the views and in which.

DETAILED DESCRIPTION

Figure 1:
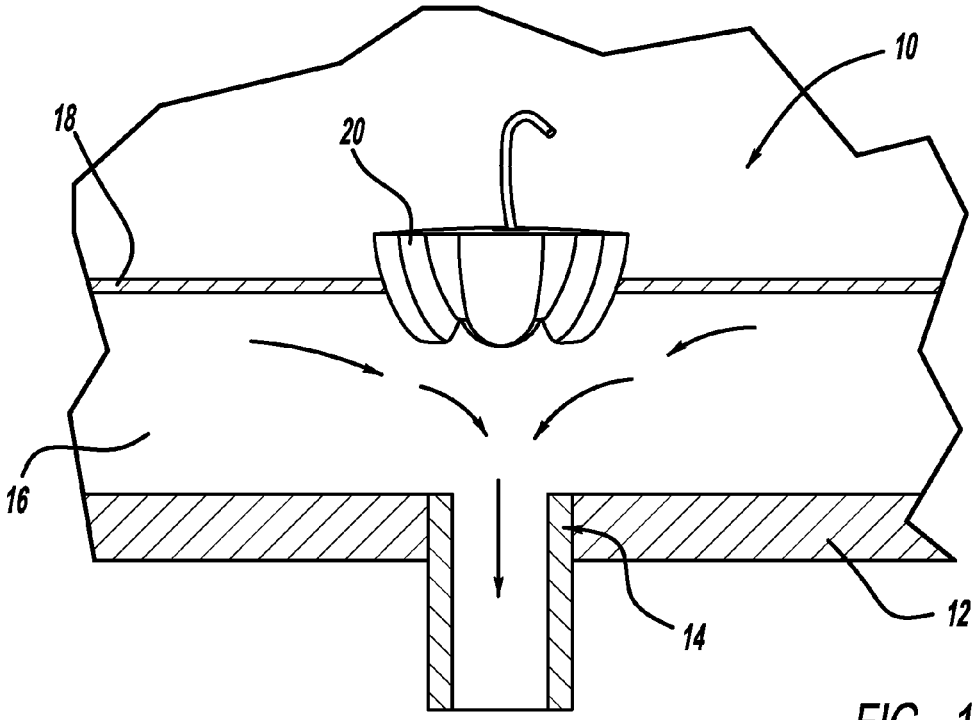
FIG. 1 is an elevational view of a molten metal receptacle containing a vortex inhibitor constructed in accordance with the present disclosure.
Figure 2:
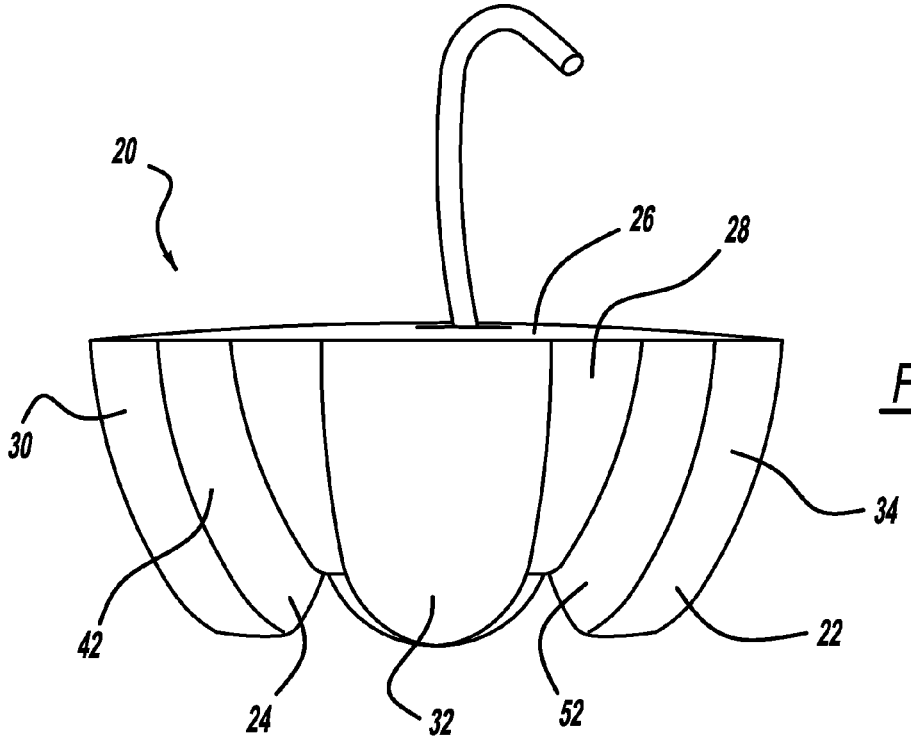
FIG. 2 is a side elevational view of the vortex inhibitor shown in FIG. 1.
Figure 3:
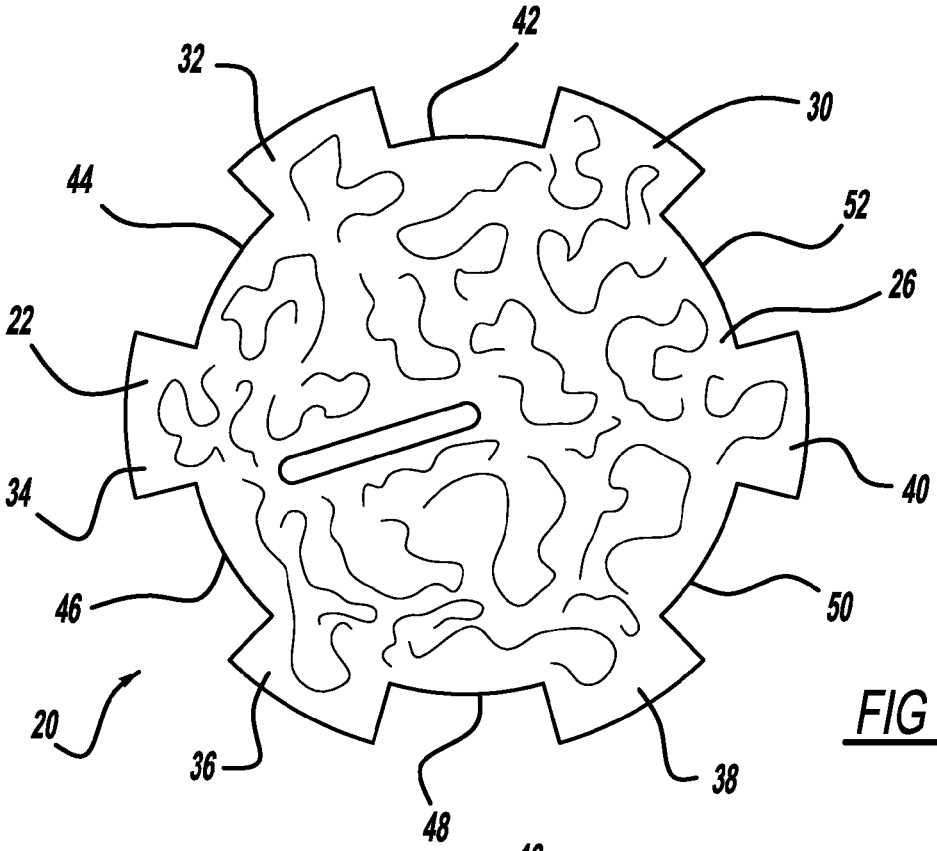
FIG. 3 is a top plan view of the vortex inhibitor shown in FIG. 1.
Figure 4:
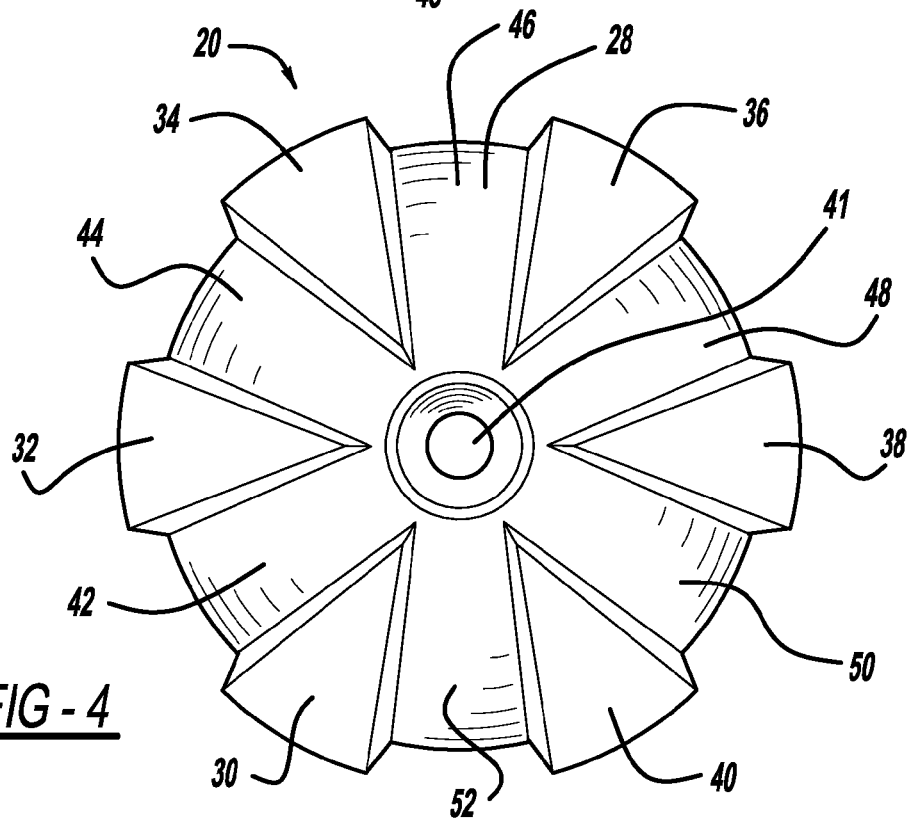
FIG. 4 is view of the apex of the vortex inhibitor shown in FIG. 1.
Figure 5:
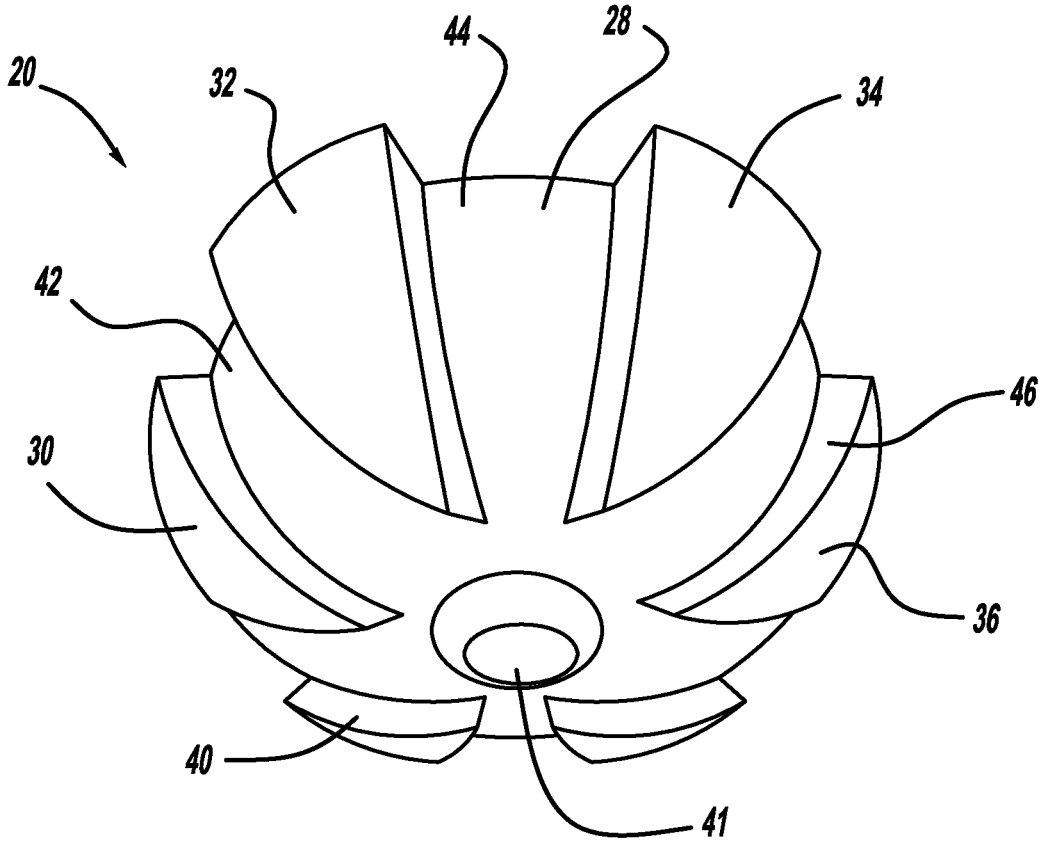
FIG. 5 is a perspective view of the vortex inhibitor shown in FIG. 1 viewed generally from the apex.

Referring first to FIG. 1, a molten metal receptacle 10 is shown having a bottom wall 12 with a discharge nozzle 14. The receptacle 10 can be a furnace, ladle, tundish or other receptacle form which molten metal is discharged through the nozzle 14. Regardless of the type of receptacle, the receptacle 10 is shown containing a layer of molten metal 16. A layer of slag 18, having a specific gravity less than the specific gravity of the molten metal 16, rests on top of the layer of molten metal 16. A vortex inhibitor 20 according to the present disclosure is shown supported at the interface of the slag layer 18 and the molten metal layer 16 within the receptacle 10.

Referring now to FIGS. 2 through 5, the vortex inhibitor 20 comprises a body 22 having a base 24 defined as an apex and a top 26. An internal cone 28 is formed within a plurality of outwardly extending elements 30, 32, 34, 36, 38 and 40. The projection (or extension) elements 30, 32, 34, 36, 38 and 40 are separated by a like number of constant dimensioned width grooves 42, 44, 46, 48, 50 and 52. It is to be understood that six outwardly extending elements are illustrated but a greater or lesser number of elements may be used. The internal cone 28 terminates in an apex 41.

The diameter of the vortex inhibitor 20 is preferably larger than the diameter of the nozzle opening 14 (which may vary with use) so that only a portion of the body 22 becomes located within the nozzle 14. Due to the harsh environmental conditions within the furnace, the diameter of the vortex inhibitor 20 may be substantially larger than the diameter of the nozzle opening 14 so that erosion of the body 22 (such as erosion of the projection [or extension] elements 30, 32, 34, 36, 38 and 40) does not substantially reduce the diameter of the outermost points of the vortex inhibitor 20 to less than the diameter of the nozzle opening 14 even if the diameter of the nozzle opening 14 gets larger with use.

The vortex inhibitor 20 may have a body 22 having a variety of suitable shapes (e.g., hemispherical, hemi-ellipsoidal, etc.) and constructions (e.g., projections, grooves, etc.). For example, according to one exemplary embodiment, the vortex inhibitor 20 may have a hemispherical shaped body portion 22 comprising, inter alia, the plurality of projection elements 30, 32, 34, 36, 38 and 40 extending radially and angularly therefrom as best viewed in FIG. 3. The projection elements 30, 32, 34, 36, 38 and 40) may extend downwardly from the top 26 of the body 22 to the base 24 of the body 22. The projection elements 30, 32, 34, 36, 38 and 40 have any suitable shape (e.g., triangular, etc.) and may be arranged or spaced in any suitable pattern (e.g., spaced equidistantly and laterally from one another, etc.).

As shown, whether there is a general hemispherical or hemi-ellipsoid shape of the body 22, the constant dimension grooves 42, 44, 46, 48, 50 and 52 in combination with the cone 28 are designed to provide a generally constant plugging effect. Accordingly, thus shaped, the vortex inhibitor 20 can fit and function effectively within a hole having an increasingly large size due to wear. This design allows the throughput to remain the same even if one follows the normal practice of allowing the hole to wear out at a rate that the final tapping is one half of the initial tapping time. Then, the drain, which is in an inverse of that function, becomes a constant put out at the termination of the tap.

Having thus described the present disclosure, many modifications thereto will become apparent to those skilled in the art to which it pertains without departing from the scope and spirit of the present disclosure as defined in the appended claim.

What is claimed is:

1. A vortex inhibitor comprising:

an internal cone that tapers from a top end to an apex, a plurality of projections that project outward from the internal cone and extend from the top end toward the apex, wherein the internal cone and the plurality of projections comprise a generally hemispherical-shaped body; and a plurality of channels that extend from the top end toward the apex and between the plurality of projections, wherein the plurality of channels intersect at the apex and wherein the vortex inhibitor comprises a castable refractory material.

2. A vortex inhibitor comprising:

an internal cone that tapers from a top end to an apex, a plurality of projections including a first projection that projects outward from the internal cone and extends from the top end toward the apex, wherein the first projection includes a triangular configuration having a base aligned with the top end and a corner that opposes the base and extends toward the apex and wherein the internal cone and the plurality of projections comprise a hemispherical-shaped body; and a plurality of channels that extend from the top end toward the apex and that are positioned on two sides of the first projection, wherein the plurality of channels intersect at the corner of the first projection and wherein the vortex inhibitor comprises a castable refractory material.

3. The vortex inhibitor of claim 2 wherein the plurality of channels have a constant width.

4. The vortex inhibitor of claim 2 wherein the internal cone includes a hemispherical shape that includes a generally constant radius from the top end to the apex.

5. The vortex inhibitor of claim 2 wherein the first projection includes a curve that extends from the base to the corner, and wherein the curve includes a generally constant radius.

6. A vortex inhibitor comprising:

an internal cone that tapers from a top end to an apex, a plurality of projections that project outward from the internal cone and extend from the top end toward the apex, wherein each projection includes a curve that extends from the top end toward the apex, and wherein the curve includes a generally constant radius; and a plurality of channels that extend from the top end toward the apex and between the plurality of projections, wherein the plurality of channels intersect near the apex and wherein the vortex inhibitor comprises a castable refractory material.

7. A vortex inhibitor comprising:

an internal cone that tapers from a top end to an apex, wherein the internal cone includes a hemispherical shape that includes a generally constant radius from the top end to the apex, a plurality of projections that project outward from the internal cone and extend from the top end toward the apex; and a plurality of channels that extend from the top end toward the apex and between the plurality of projections, wherein the plurality of channels intersect near the apex and wherein the vortex inhibitor comprises a castable refractory material.

* * * * *